US006608304B1

(12) United States Patent
Littlejohn et al.

(10) Patent No.: US 6,608,304 B1
(45) Date of Patent: Aug. 19, 2003

(54) AUTOMATIC BACKGROUND EJECTION (ABE)

(75) Inventors: Duane P. Littlejohn, Manlius; Thomas Knudsen, Fayetteville, both of NY (US)

(73) Assignee: Siemens Energy & Automation, Alpharetta, GA (US)

( * ) Notice: Subject to any disclaimer, the term of this patent is extended or adjusted under 35 U.S.C. 154(b) by 258 days.

(21) Appl. No.: 09/676,819

(22) Filed: Oct. 2, 2000

Related U.S. Application Data

(60) Provisional application No. 60/157,499, filed on Oct. 4, 1999, provisional application No. 60/157,498, filed on Oct. 4, 1999, provisional application No. 60/157,374, filed on Oct. 1, 1999, provisional application No. 60/157,375, filed on Oct. 1, 1999, provisional application No. 60/157,376, filed on Oct. 1, 1999, and provisional application No. 60/157,377, filed on Oct. 1, 1999.

(51) Int. Cl.[7] ..... H01J 49/40

(52) U.S. Cl. ..... 250/293; 250/289

(58) Field of Search ..... 250/293, 282, 250/289, 291

(56) References Cited

U.S. PATENT DOCUMENTS 5,451,782 A * 9/1995 Kelley ..... 250/282
5,841,237 A * 11/1998 Alton ..... 315/111.81
6,004,104 A * 12/1999 Rutherford ..... 417/49

* cited by examiner

*Primary Examiner*—Bruce Anderson
*Assistant Examiner*—Zia R. Hashmi

(57) ABSTRACT

A mass spectrometer (MS) which uses the Fourier transform ion cyclotron resonance (FTICR) technique to determine the mass of ions. The MS is prepared with a surface that guarantees that a particle striking the surface will have at least one contact with the cathode and will most likely be re-pumped before escaping into the vacuum chamber volume.

2 Claims, 5 Drawing Sheets

AUTOMATIC BACKGROUND EJECTION (ABE)

PRIORITY OF INVENTION

This invention claims priority to the Provisional Application(s) 60/157,499 and 60/157,498 both filed Oct. 4, 1999 and 60/157,374, 60/157,375, 60/157,376, 60/157,377 all filed Oct. 1, 1999.

BACKGROUND

1. Field of the Invention

This invention relates to a mass spectrometer (MS) and more particularly to a MS which uses the Fourier transform ion cyclotron resonance (FTICR) technique to determine the mass of ions.

2. Description of the Related Art

When a gas phase ion at low pressure is subjected to a uniform static magnetic field, the resulting behavior of the ion is determined by the magnitude and orientation of the ion velocity with respect to the magnetic field. if the ion is at rest, or if the ion has only a velocity parallel to the applied field, the ion experiences no interaction with the field. If there is a component of the ion velocity that is perpendicular to the applied field, the ion will experience a force that is perpendicular to both the velocity component and the applied field. This force results in a circular ion trajectory that is referred to as ion cyclotron motion. In the absence of any other forces on the ion, the angular frequency of this motion is a simple function of the ion charge, the ion mass, and the magnetic field strength:

$$\omega = qB/m \qquad \text{Eq.1}$$

where: ω=angular frequency (radians/second)

q=ion charge (coulombs)

B=magnetic field strength (tesla)

m=ion mass (kilograms)

The FTICR MS exploits the fundamental relationship described in Equation 1 to determine the mass of ions by inducing large amplitude cyclotron motion and then determining the frequency of the motion. The first use of the Fourier transform in an ion cyclotron resonance mass spectrometer is described in U.S. Pat. No. 3,937,955 entitled "Fourier Transform Ion Cyclotron Resonance Spectroscopy Method And Apparatus" issued to M. B. Comisarow and A. G. Marshall on Feb. 10, 1976.

The ions to be analyzed are first introduced to the magnetic field with minimal perpendicular (radial) velocity and dispersion. The cyclotron motion induced by the magnetic field effects radial confinement of the ions; however, ion movement parallel to the axis of the field must be constrained by a pair of "trapping" electrodes. These electrodes typically consist of a pair of parallel-plates oriented perpendicular to the magnetic axis and disposed on opposite ends of the axial dimension of initial ion population. Thee trapping electrodes are maintained at a potential that is of the same sign as the charge of the ions and of sufficient magnitude to effect axial confinement of the ions between the electrode pair.

The trapped ions are then exposed to an electric field that is perpendicular to the magnetic field and oscillates at the cyclotron frequency of the ions to be analyzed. Such a field is typically created by applying appropriate differential potentials to a second pair of parallel-plate "excite" electrodes oriented parallel to the magnetic axis and disposed on opposing sides of the radial dimension of the initial ion population.

If ions of more than one mass are to be analyzed, the frequency of the oscillating field may be swept over an appropriate range, or be comprised of an appropriate mix of individual frequency components. When the frequency of the oscillating field matches the cyclotron frequency for a given ion mass, all of the ions of that mass will experience resonant acceleration by the electric field and the radius of their cyclotron motion will increase.

An important feature of this resonant acceleration is that the initial radial dispersion of the ions is essentially unchanged. The excited ions will remain grouped together on the circumference of the new cyclotron orbit, and to the extent that the dispersion is small relative to the new cyclotron radius, their motion will be mutually in phase or coherent. If the initial ion population consisted of ions of more than one mass, the acceleration process will result in a multiple isomass ion bundles, each orbiting at its respective cyclotron frequency.

The acceleration is continued until the radius of the cyclotron orbit brings the ions near enough to one or more detection electrodes to result in a detectable image charge being induced on the electrodes. Typically these "detect" electrodes will consist of a third pair of parallel-plate electrodes disposed on opposing sides of the radial dimension of the initial ion population and oriented perpendicular to both the excite and trap electrodes. Thus the three pairs of parallel-plate electrodes employed for ion trapping, excitation, and detection are mutually perpendicular and together form a closed box-like structure referred to as a trapped ion cell. FIG. 1 shows a simplified diagram for a trapped ion cell 12 having trap electrodes 12*a* and 12*b*; excite electrodes 12*c* and 12*d*; and detect electrodes 12*e* and 12*f*.

As the coherent cyclotron motion within the cell causes each isomass bundle of ions to alternately approach and recede from a detection electrode 12*e*, 12*f*, the image charge on the detection electrode correspondingly increases and decreases. If the detection electrodes 12*e*, 12*f* are made part of an external amplifier circuit (not shown), the alternating image charge will result in a sinusoidal current flow in the external circuit. The amplitude of the current is proportional to the total charge of the orbiting ion bundle and is thus indicative of the number of ions present. This current is amplified and digitized, and the frequency data is extracted by means of the Fourier transform. Finally, the resulting frequency spectrum is converted to a mass spectrum using the relationship in Equation 1.

Referring now to FIG. 2, there is shown a general implementation of a FTICR MS 10. The FTICR MS 10 consists of seven major subsystems necessary to perform the analytical sequence described above. The trapped ion cell 12 is contained within a vacuum system 14 comprised of a chamber 14*a* evacuated by an appropriate pumping device 14*b*. The chamber is situated within a magnet structure 16 that imposes a homogeneous static magnetic field over the dimension of the trapped ion cell 12. While magnet structure 16 is shown in FIG. 2 as a permanent magnet, a superconducting magnet may also be used to provide the magnetic field.

The sample to be analyzed is admitted to the vacuum chamber 14*a* by a sample introduction system 18 that may, for example, consist of a leak valve or gas chromatograph column. The sample molecules are converted to charged species within the trapped ion cell 12 by means of an ionizer 20 which typically consists of a gated electron beam passing through the cell 12, but may consist of a photon source or other means of ionization. Alternatively, the sample molecules may be created external to the vacuum chamber 14*a* by any one of many different techniques, and then injected along the magnetic field axis into the chamber 14*a* and trapped ion cell 12.

The various electronic circuits necessary to effect the trapped ion cell events described above are contained within an electronics package 22 which is controlled by a computer based data system 24. This data system 24 is also employed to perform reduction, manipulation, display, and communication of the acquired signal data.

SUMMARY OF THE INVENTION

A mass spectrometer (MS) is disclosed which uses the Fourier transform ion cyclotron resonance (FTICR) technique to determine the mass of ions. The MS is prepared with a surface that guarantees that a particle striking the surface will have at least one contact with the cathode and will most likely be re-pumped before escaping into the vacuum chamber volume.

DESCRIPTION OF THE PREFERRED EMBODIMENT (S)

The problem is that FTICR mass spectrometers require ultra high vacuum to operate. The pump initially used for the FTICR has a "diode" geometry. Ion pumps have the characteristic that the sputtering process that provides the sputtered titanium pumping surface, also dislodges a small fraction of the gas that has previously been "pumped". This effect can contribute an error in subsequent samples when sampling the same gas continuously as in process monitoring. This effect is most noticeable in the dislodging of permanent gases such as Argon and Helium since these gases are not chemically bonded to the reactive Titanium as other molecules are. Several pumps of different geometry have been used to reduce this effect. Subject of this invention is an improved triode geometry using an Anti Back Scatter (ABS) catcher to further reduce the chance that previously pumped molecules can be dislodged from the surface. Expected improvement is about 100 times the current technology.

The most widely used is a Varian Associates "Star Cell" geometry that reduces the energy of the high energy sputtering ions that collide with the Titanium surface thereby reducing the number of molecules that are dislodged from the pumping surface. It is not used to solve the problem because Varian has a patent in force and is about 100 times less effective than the proposed invention. In addition to the pump geometry to limit the secondary discharge effects, another Jencourt patent described in another disclosure provides a method by which the pump is turned off during the admission of a new gas sample thereby avoiding the problem. However, this is accomplished by use of a high voltage reed relay, which will have a finite lifetime. The proposed ABS catcher does not.

Figure 1:
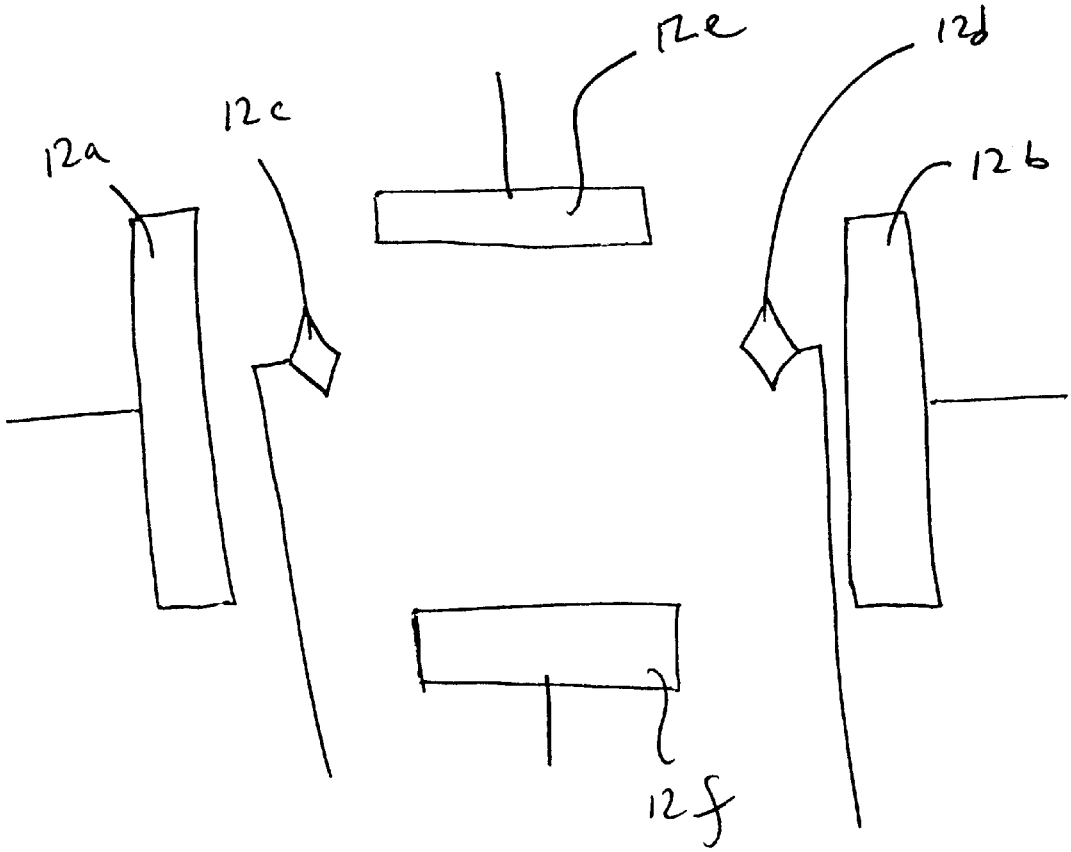
FIG. 1 shows a trapped ion cell.
Figure 2:
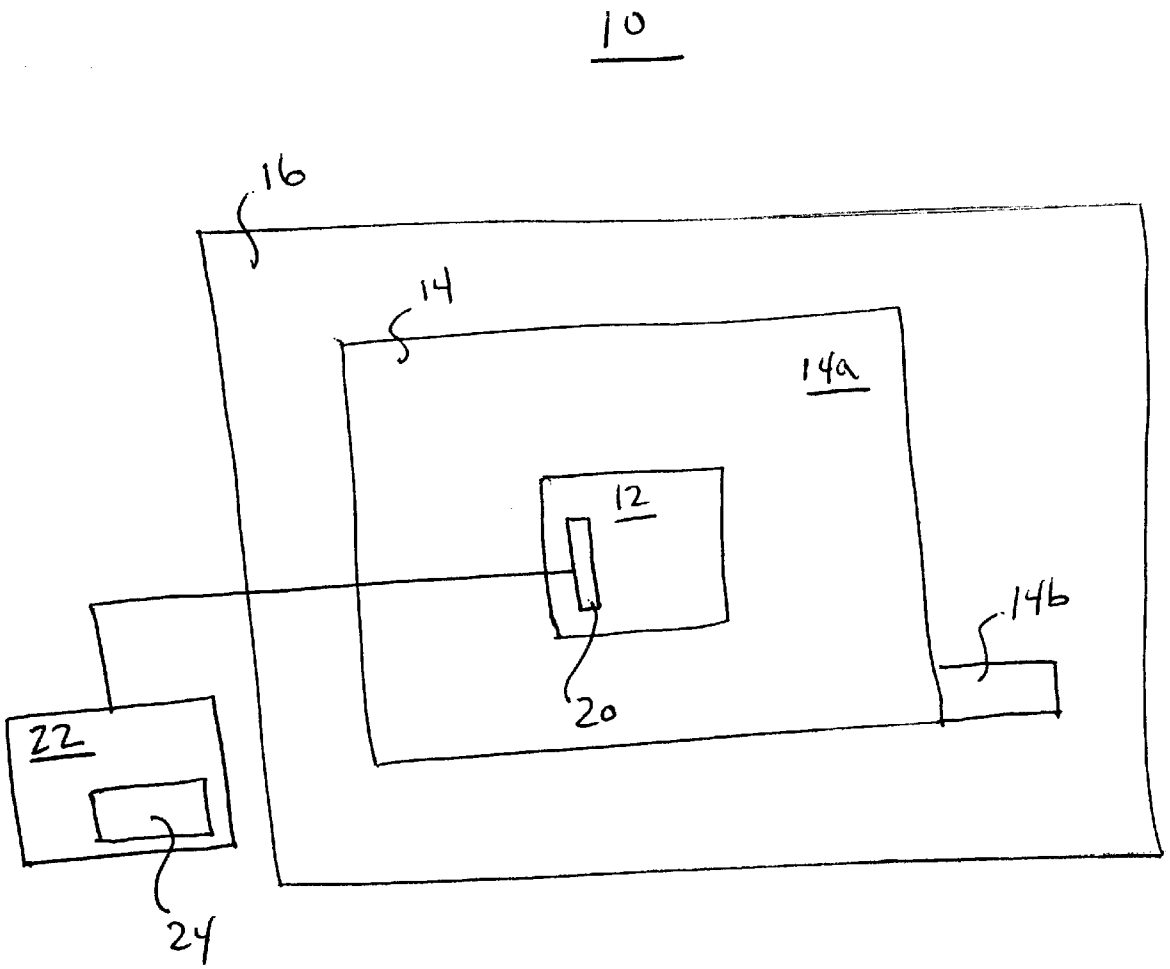
FIG. 2 shows a magnet structure.
Figure 3A:
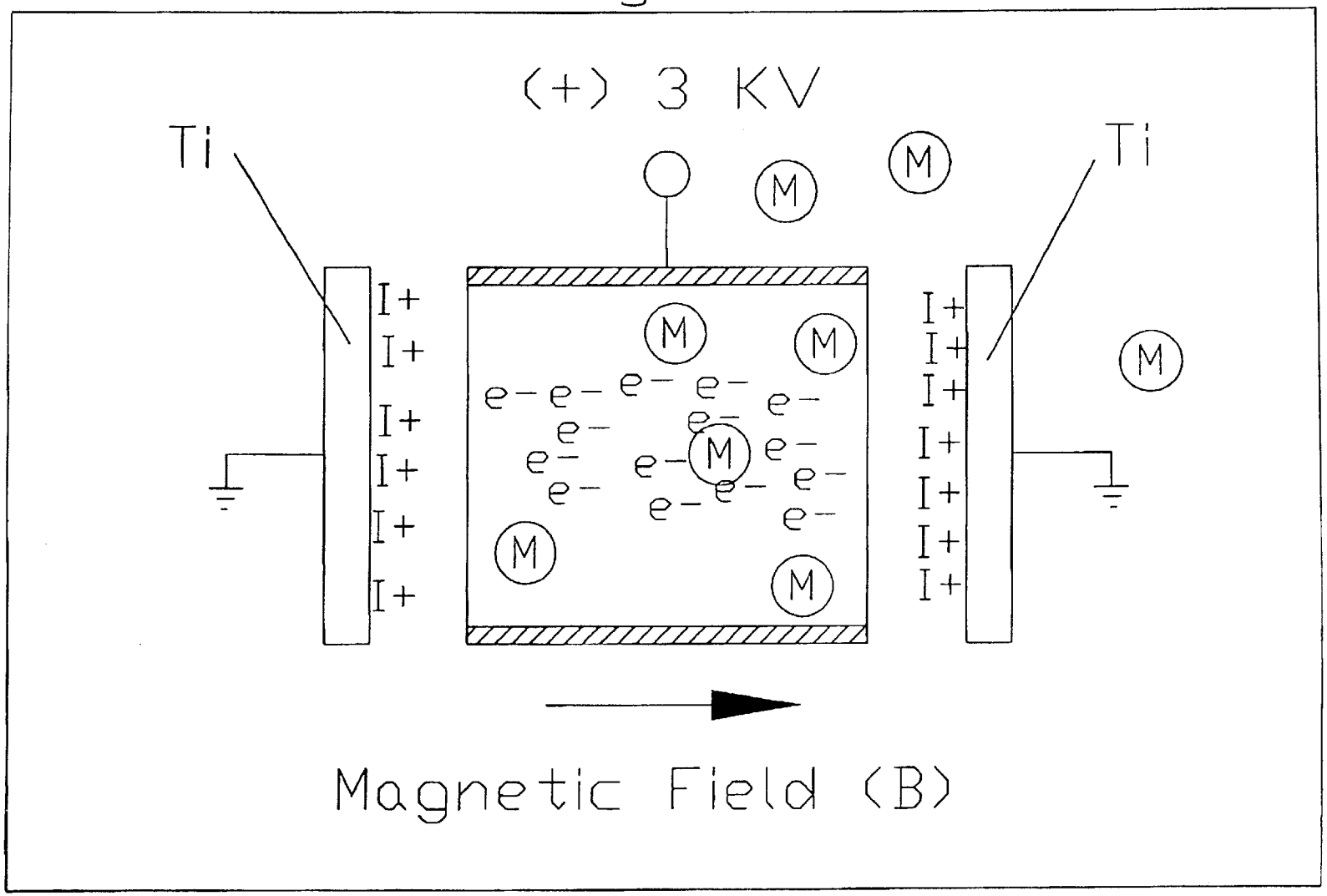
FIG. 3*a* shows a Penning Cell type ion pump.

The Ion Pump, in its most basic form, is a Penning Cell that has the function of trapping charged particles within the cell volume. Physically it consists of a right circular cylinder with a flat electrode made of Titanium at each end of the cylinder with the plane of the electrodes perpendicular to the axis of the cylinder. The three elements or electrodes are each electrically isolated from the others and are all immersed in a magnetic field of about 1200 Gauss with its axis coincident with the cylinder axis. Usually the Titanium electrodes are at a negative or ground potential while the cylinder is supplied with a positive 3000 volt potential. Electrons, initiated by field ionization, are trapped in the volume of the cylinder. When neutral molecules randomly find their way into the volume of the cell, they are bombarded with the energetic electrons and are broken apart or fragmented by stripping an electron from one or more of the molecular bonds. The remaining particle or ion is left with a net positive charge. It is repelled by the positive charge on the cylinder and is driven at high velocity into the Titanium cathode. Titanium metal is sputtered from the surface where it re-condenses to leave a very chemically reactive surface. Molecules contacting the surface are bonded chemically and "pumped". Permanent gases such as Argon and Helium are not chemically reactive and instead are buried by the sputtering and re-condensing process. Much less energy is required to dislodge these permanent gases than the other chemically bonded molecules. (See FIG. 3a)

Figure 3B:
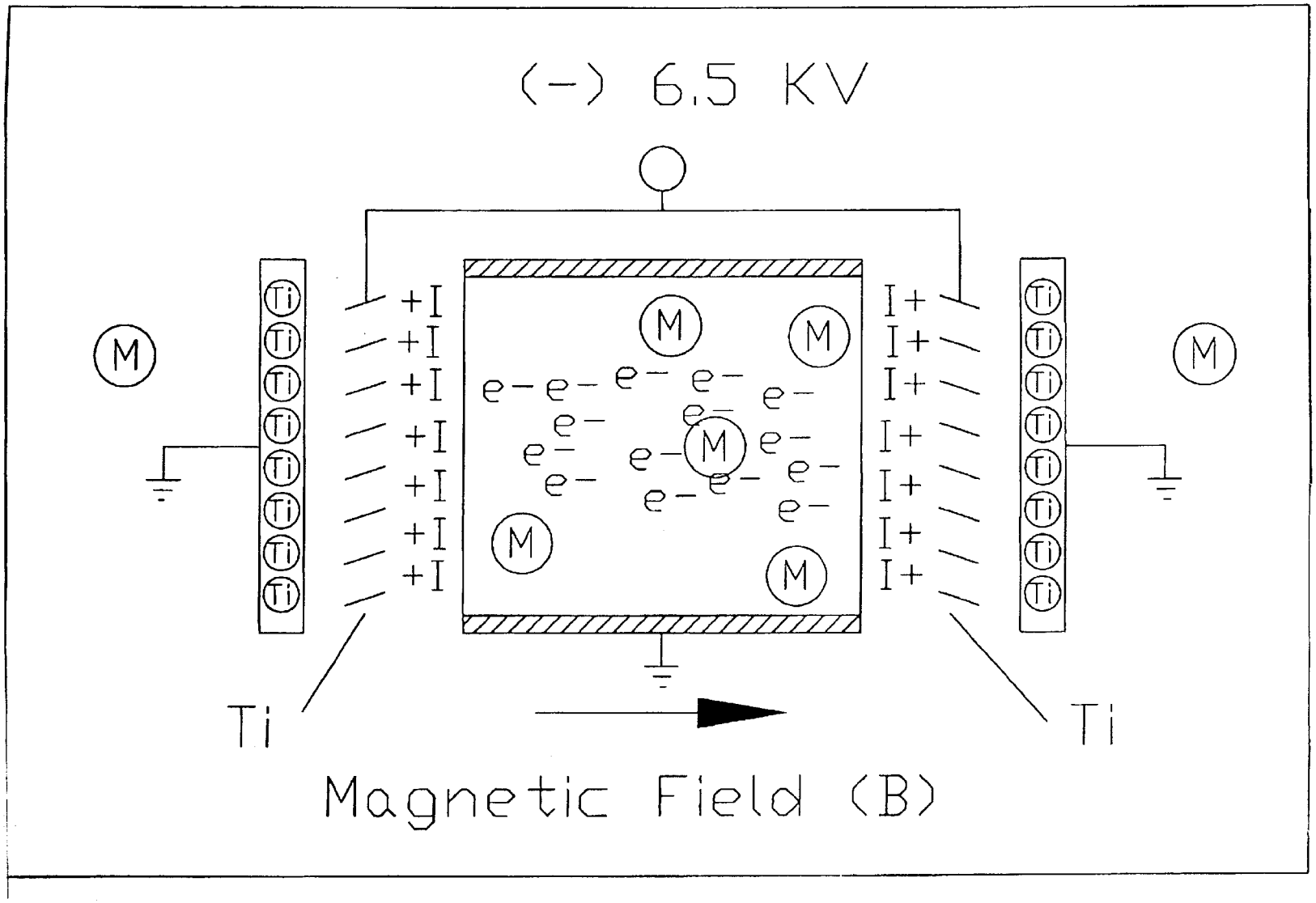
FIG. 3*b* shows a Varian Starr Cell.

The Varian Starr Cell with its triode geometry is shown in FIG. 3*b*. In this case the Anode and both cathodes are at ground potential while the Titanium sputtering cathode is typically supplied with a Negative 6500 volts D.C. The shape of t he Titanium cathode assures a glancing angle collision with the energetic ions produced in the cell and accelerated toward the cathode. This reduces the number of high velocity ions that can strike the catcher cathodes and hence the number of dislodged pre-pumped molecules. However, this geometry still allows a large number of ions to be accelerated into the catcher and a significant number of secondary molecules are still dislodged.

Figure 4:
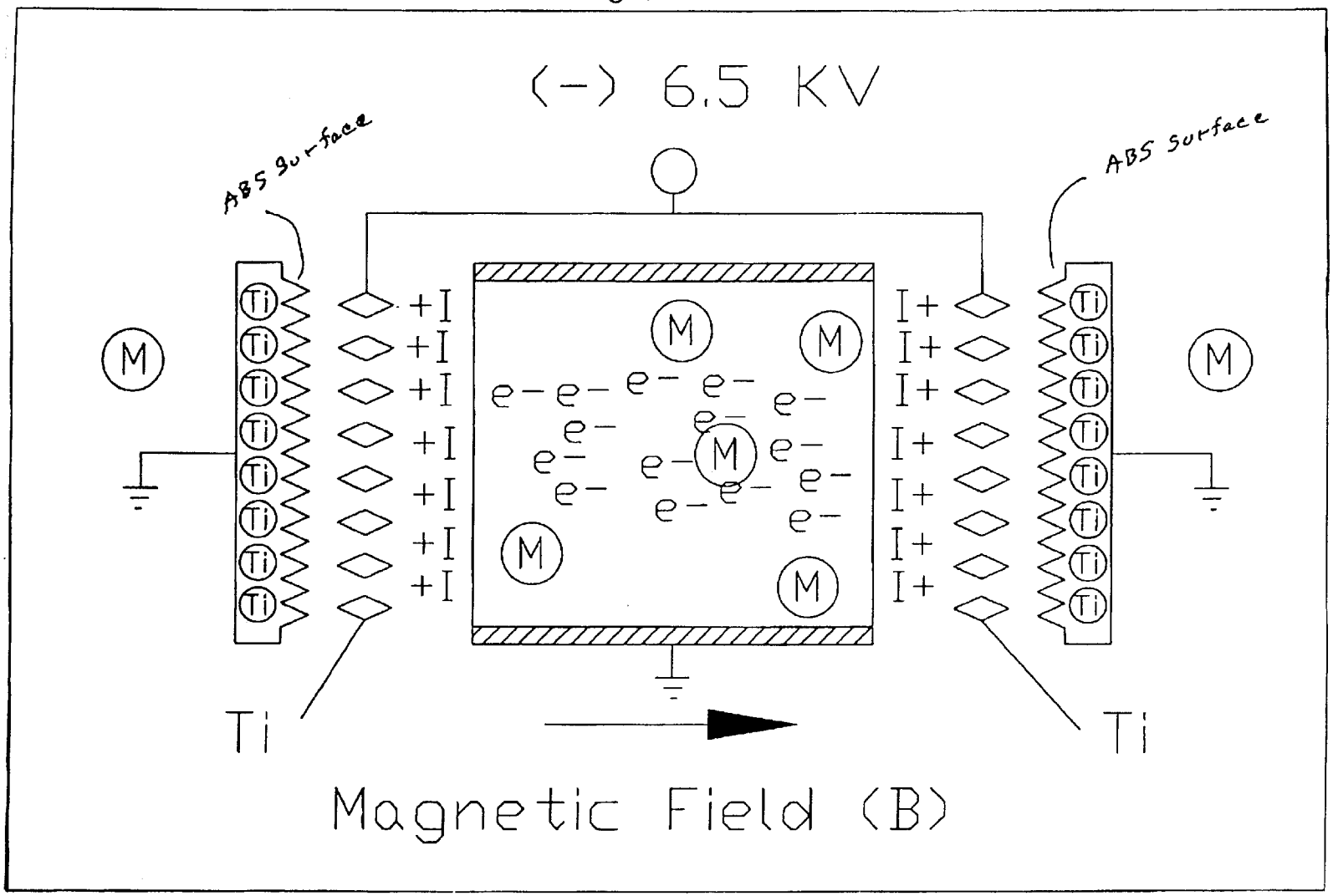
FIG. 4 shows an Anti Back Scatter Catcher.

This invention, the Ant i Back Scatter Catch e r, or ABS catcher shown in FIG. 4 is prepared with a surface that guarantees that a particle striking the surface will have at least one contact with the cathode. As specifically shown in the figure, the surface is grooved with a preferably deeper than wider aspect, which gives the grooves a steep angle. In effect, the charged particles are likely to strike the peaks of the grooves, thereby expending energy, and thereafter captured by the surface. As a result, the particlehs) are re-pumped before escaping into the vacuum chamber volume. Preliminary tests show an improvement of a factor of a hundred. This level would probably not be detected and would allow removal of the reed relay controls currently in use. The FTICR mass spectrometer is a very sensitive detector. It can detect and quantify samples amounting to as few as 200 ions. However, due to limitations of mutual space charge, the analyzer cell can contain only a finite amount of ions total. When the component of interest represents a fraction of the total number of ions in the cell volume that is less than the minimum detectable threshold of 200 ions, the trace component is not detectable. In many cases the trace component is the only ion of interest as in the case of air sampling where the normal components of air are already known. Common practice in FTICR is to over excite the unwanted ions during the ionization period. This ejects the unwanted ions and enriches the cell with the trace ion (s) of interest. The conventional method used is manual in nature and requires a skilled operator in attendance. This would not be acceptable in the applications that we envision for this instrument.

This invention provides a programmable means to select the trace components of interest and the program automatically selects the excite frequencies to eject all other unwanted ions during the ionization event. We will call this capability Automatic Background Ejection (ABE).

It is to be understood that the description of the preferred embodiments) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. An ion pump in combination with an ionization chamber comprising of charged particles, which arc initiated by field ionization in a vacuum chamber volume, that bombard samples immersed in a magnetic field, said samples break apart due to the bombardment yielding an oppositely charged fragment, which is driven to a detection cathode, said ion pump comprising a surface of said detection cathode which automatically select excite frequencies of said fragmented ions to eject unwanted ions during said field ionization.

2. The ion pump of claim 1 wherein said unwanted ions are ejected automatically.

* * * * *